US010294627B2

(12) United States Patent
Bechler et al.

(10) Patent No.: US 10,294,627 B2
(45) Date of Patent: May 21, 2019

(54) SUMP BACKFILL PROTECTOR

(71) Applicants: Russell A. Bechler, Centerville, OH (US); Kevin Allen Webster, Clayton, NC (US)

(72) Inventors: Russell A. Bechler, Centerville, OH (US); Kevin Allen Webster, Clayton, NC (US)

(73) Assignee: OPW FUELING COMPONENTS, LLC, Hamilton, OH (US)

( * ) Notice: Subject to any disclaimer, the term of this patent is extended or adjusted under 35 U.S.C. 154(b) by 0 days.

(21) Appl. No.: 15/879,730

(22) Filed: Jan. 25, 2018

(65) Prior Publication Data

US 2018/0223498 A1 Aug. 9, 2018

Related U.S. Application Data

(60) Provisional application No. 62/454,415, filed on Feb. 3, 2017.

(51) Int. Cl.

| | |
|---|---|
| ***E02D 29/14*** | (2006.01) |
| ***E03F 5/04*** | (2006.01) |
| ***E03F 5/042*** | (2006.01) |

(52) U.S. Cl.
CPC ..... *E02D 29/1427* (2013.01); *E02D 29/1436* (2013.01); *E03F 5/042* (2013.01)

(58) Field of Classification Search
CPC ... E02D 29/1427; E02D 29/1436; E95F 5/042
See application file for complete search history.

(56) References Cited

U.S. PATENT DOCUMENTS

| | | | | | |
|---|---|---|---|---|---|
| 1,959,171 | A * | 5/1934 | Mayer | E02D 29/1409 | 49/33 |
| 2,045,083 | A * | 6/1936 | Illig | E02D 29/1427 | 16/429 |
| 3,611,889 | A * | 10/1971 | Levinson | E02D 29/1409 | 220/3.7 |
| 4,793,387 | A * | 12/1988 | LeBlanc | B65D 90/105 | 137/312 |
| 5,628,152 | A * | 5/1997 | Bowman | B65D 90/105 | 137/364 |
| 5,769,565 | A * | 6/1998 | Martin, Jr. | E03F 5/02 | 137/370 |
| 6,044,591 | A * | 4/2000 | Hegler | E03F 5/02 | 285/197 |

(Continued)

FOREIGN PATENT DOCUMENTS

| | | | | |
|---|---|---|---|---|
| BE | 1008186 A6 * | 2/1996 | E02D 29/1427 |
| DE | 29601296 U1 * | 4/1996 | E02D 29/1427 |
| GB | 2235231 A * | 2/1991 | E02D 29/12 |

OTHER PUBLICATIONS

Product Information featuring "OPW Conquistador™ Plus Composite Cover Manholes" www.opwglobal.com (2015).

*Primary Examiner* — Jeanette E Chapman
(74) *Attorney, Agent, or Firm* — Thompson Hine LLP

(57) ABSTRACT

A system including a backfill protector including a skirt having an opening configured to receive a cover therein and a lip extending around a perimeter of the opening. The lip is configured to support the cover thereon, and the skirt further includes an inwardly-extending channel positioned adjacent to the lip.

23 Claims, 5 Drawing Sheets

(56) References Cited

U.S. PATENT DOCUMENTS

| | | | | |
|---|---|---|---|---|
| 6,266,928 | B1 * | 7/2001 | Argandona | B65D 90/105 220/567.1 |
| 7,144,184 | B1 * | 12/2006 | Tsai | F16B 7/0486 403/350 |
| 7,144,189 | B1 * | 12/2006 | Bongiovanni | B65D 90/105 404/25 |
| 7,225,587 | B2 * | 6/2007 | Shinehouse | E03F 11/00 52/19 |
| 7,887,251 | B1 * | 2/2011 | Wang | E02D 29/1427 404/25 |
| 7,887,252 | B1 * | 2/2011 | Wang | E02D 29/1427 404/25 |
| 7,966,786 | B2 * | 6/2011 | Koteskey | E02D 29/12 220/4.04 |
| 8,156,773 | B1 * | 4/2012 | Olson | E02D 29/1427 70/168 |
| 9,765,498 | B2 * | 9/2017 | Mitola | E02D 29/1427 |
| 2016/0160532 | A1 * | 6/2016 | Patino | E05B 65/006 70/167 |

* cited by examiner

SUMP BACKFILL PROTECTOR

This application claims priority to U.S. Provisional Patent Application Ser. No. 62/454,415, filed on Feb. 3, 2017 and entitled SUMP BACKFILL PROTECTOR, the entire contents of which are hereby incorporated by reference.

The present invention is directed to a sump backfill protector, and more particularly, to a sump backfill protector which is configured to provide increased strength.

BACKGROUND

Sumps and other storage/containment devices are often used for containing pumps or other fluid handling equipment, along with associated pipe junctions, electrical connections and the like. A backfill protector is often positioned on top of the sump, and has an opening to provide access to the sump. A cover, such as a manhole cover or the like, is positionable in the opening of the backfill protector. Many current backfill protectors are made of relatively thick material to provide sufficient strength and durability. However, such backfill protectors can be relatively heavy and expensive to manufacture, and can be difficult to transport and install.

SUMMARY

In one embodiment the present invention is a sump backfill protector that is configured to provide increased strength, such as in one case by having a recess or channel that is configured to receive backfill material therein to thereby strengthen the backfill protector. More particularly, in one embodiment the invention is a system including a backfill protector including a skirt having an opening configured to receive a cover therein and a lip extending around a perimeter of the opening. The lip is configured to support the cover thereon, and the skirt further includes an inwardly-extending channel positioned adjacent to the lip.

DETAILED DESCRIPTION

Figure 1:
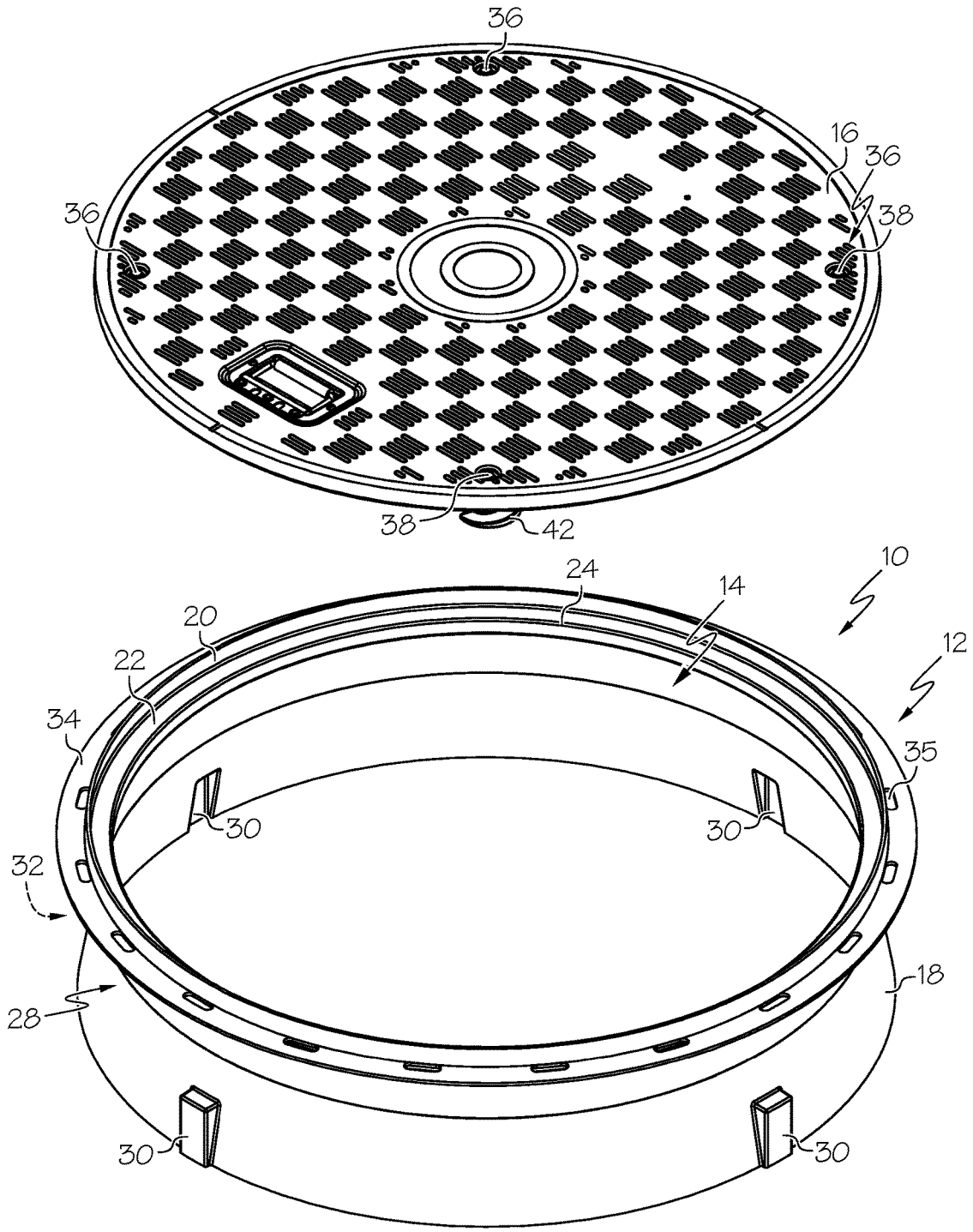
FIG. 1 is a perspective view of one embodiment of the backfill protector, shown in conjunction with a cover exploded away from the backfill protector.
Figure 2:
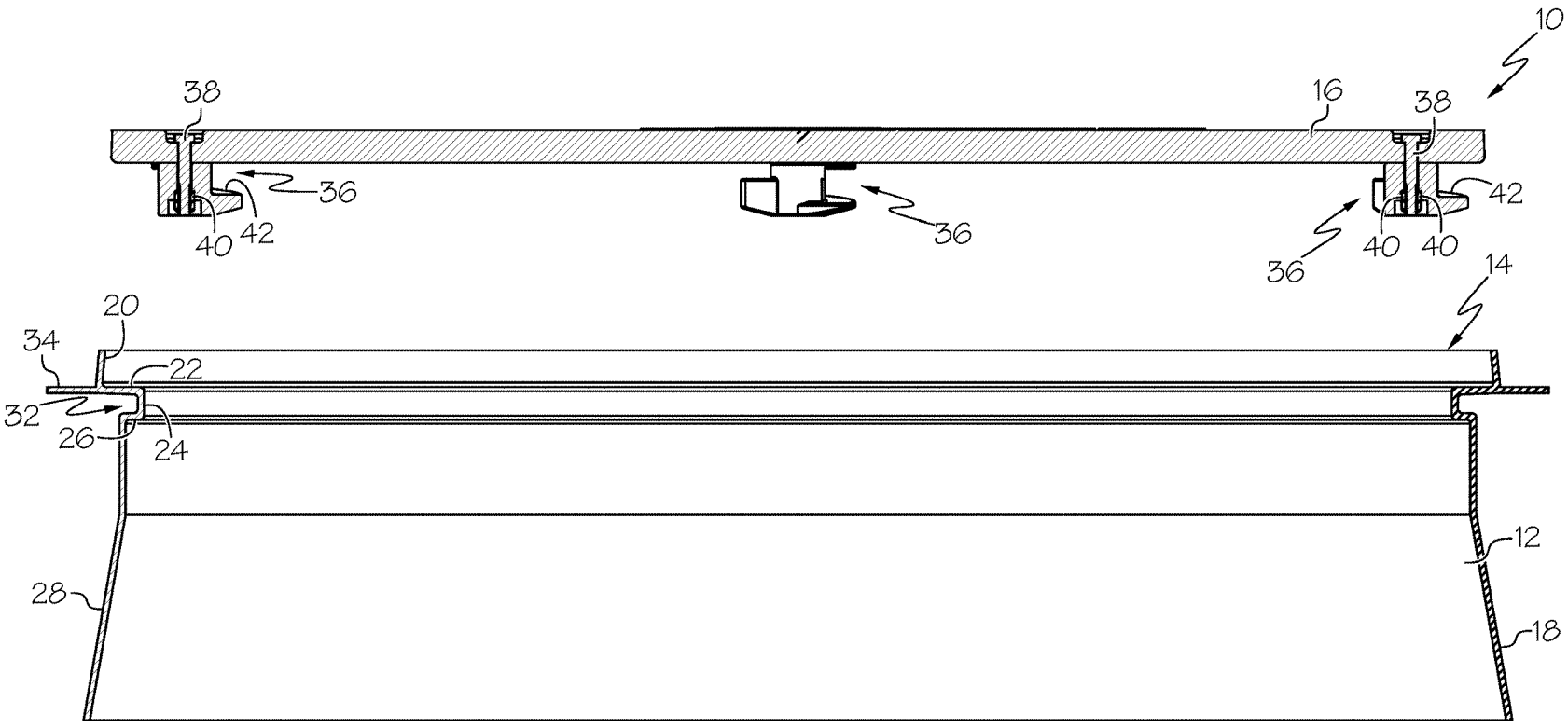
FIG. 2 is a side view of the backfill protector and cover of FIG. 1.
Figure 3:
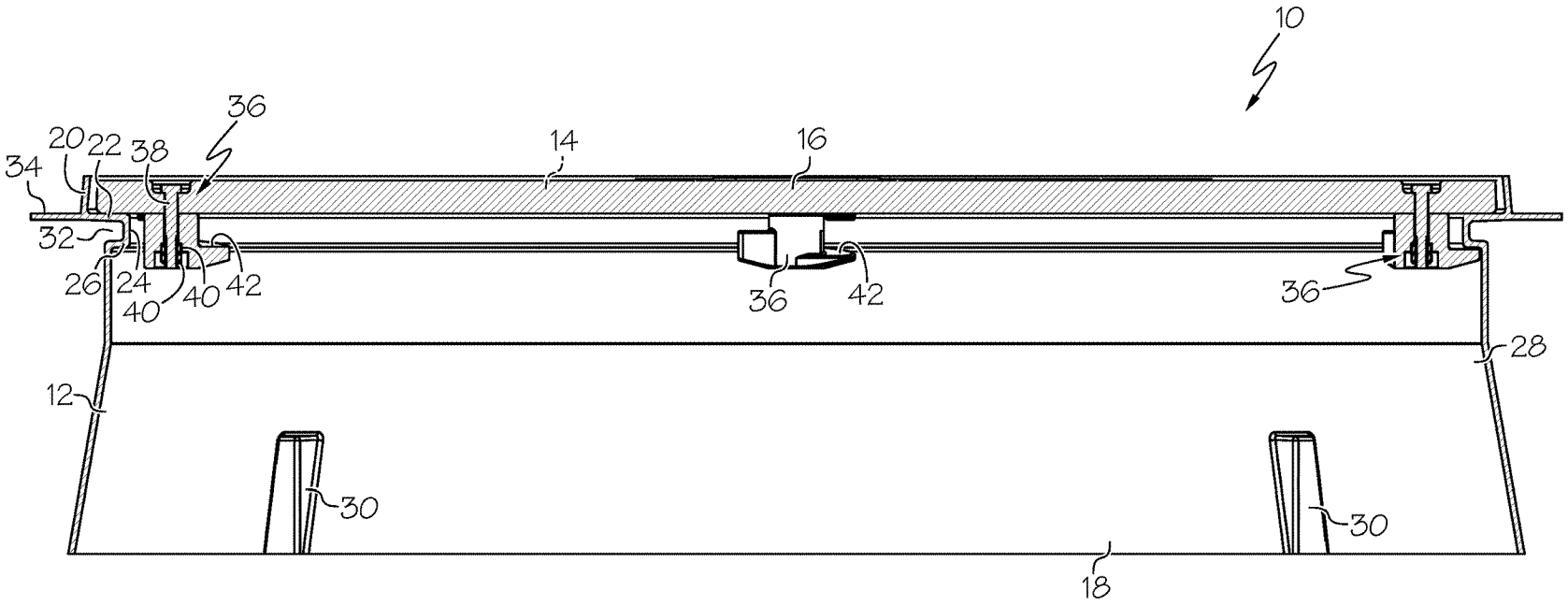
FIG. 3 is side view of the backfill protector and cover of FIG. 2, with the cover received in the backfill protector.
Figure 4:
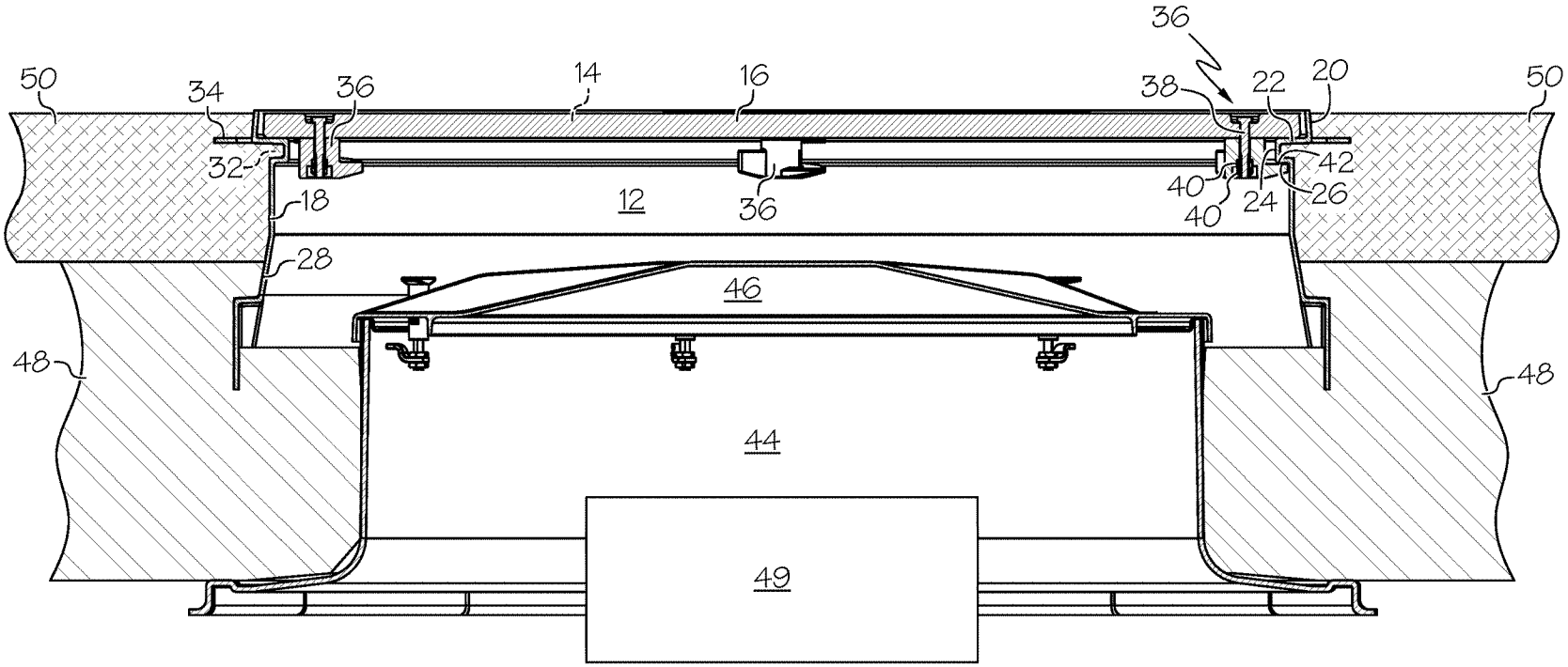
FIG. 4 is a side view of the backfill protector and cover of FIG. 3, shown in conjunction with a sump and backfill material.

FIG. 1 shows a backfill protection system 10 include a backfill protector 12 having an upper opening 14 and a cover 16 configured to be received in the backfill protector 12 to fill/cover the upper opening 14. The backfill protector 12 can be generally annular in shape (circular in top view) and have a skirt 18 which defines all or a majority of the structure of the backfill protector 12. With reference to FIG. 2, the backfill protector 12/skirt 18 has an axially-extending/oriented upper sidewall 20 which defines the (circular, in one case) opening 14 and can have a size/diameter slightly larger than a size/diameter of the cover 16 so that the cover 16 can be closely received inside the upper sidewall 20, as shown in FIGS. 3 and 4. The backfill protector 12/skirt 18 can have a radially extending/oriented upper lip 22 adjacent to a lower edge of the upper sidewall 20 and extending radially inwardly therefrom. At least a radially inner portion of the upper lip 22 can have a size/diameter smaller than a size/diameter of the cover 16 so that the upper lip 22 can support the cover 16 thereon as shown in FIGS. 3 and 4.

The backfill protector 12/skirt 18 includes a lower sidewall 24 extending axially downwardly from the upper lip 22, and a radially-extending lower lip 26 extending radially outwardly from the lower sidewall 24. In the illustrated embodiment the upper lip 22 is positioned above and has a greater length (in the radial direction) than the lower lip 26. The backfill protector 12/skirt 18 also includes an annular lower body 28 positioned axially below the lower lip 26. As shown in FIG. 1, the lower body 28 can include a set of circumferentially-spaced, radially-outwardly protruding protrusions 30 spaced thereabout, each of which extends radially outwardly from a remainder of the lower body 28.

The upper lip 22, lower sidewall 24, and the lower lip 26 define a radially outwardly-facing or outwardly-opening recess or channel 32 that is configured in a generally sideways "U" shape in the illustrated embodiment. The backfill protector 12/skirt 18 also includes a flange 34 extending radially outwardly from the upper lip 22 and channel 32 (and can also at least partially define the channel 32). The flange 34 is generally aligned with the upper lip 22 in the illustrated embodiment, and can also be integrally formed therewith such that the flange 34 and upper lip 22 are in one case a unitary, one-piece seamless piece of material. If desired the flange 34 can include a set of circumferentially spaced openings 35 formed therein for weight and/or cost reduction.

In the illustrated embodiment the upper sidewall 20 and lower sidewall 24 are each generally positioned in/aligned in circumferential planes (e.g. flat planes defined by a circumferential line), and the upper lip 22, lower lip 26 and flange 34 are all generally positioned in/aligned in parallel radial planes (e.g. cylindrical planes defined by a fixed radius). Each of the upper sidewall 20, upper lip 22, lower sidewall 24, lower lip 26, flange 34 and lower body 28 can be generally annular and extend continuously 360 degrees about the backfill protector 12/skirt 18. However in some cases if desired any one of the upper sidewall 20, upper lip 22, lower sidewall 24, lower lip 26, flange 34 and lower body 28 can be discontinuous and extend around only some, or a majority, of the perimeter of the backfill protector 12/skirt 18. The upper sidewall 20, upper lip 22, lower sidewall 24, lower lip 26, flange 34 and/or lower body 28 (e.g., in one case the backfill protector 12/skirt 18 as a whole) can be formed from a single, unitary integral seamless piece of material, such as by molding. However, in other cases the backfill protector 12/skirt 18 can be made of multiple pieces joined together, such as a multi-piece weldment. Moreover, the skirt 18, opening 14, and/or cover 16 need not necessarily be circular/annular, and can instead have a variety of regular geometric shapes, or other shapes, in top view.

Figure 5:
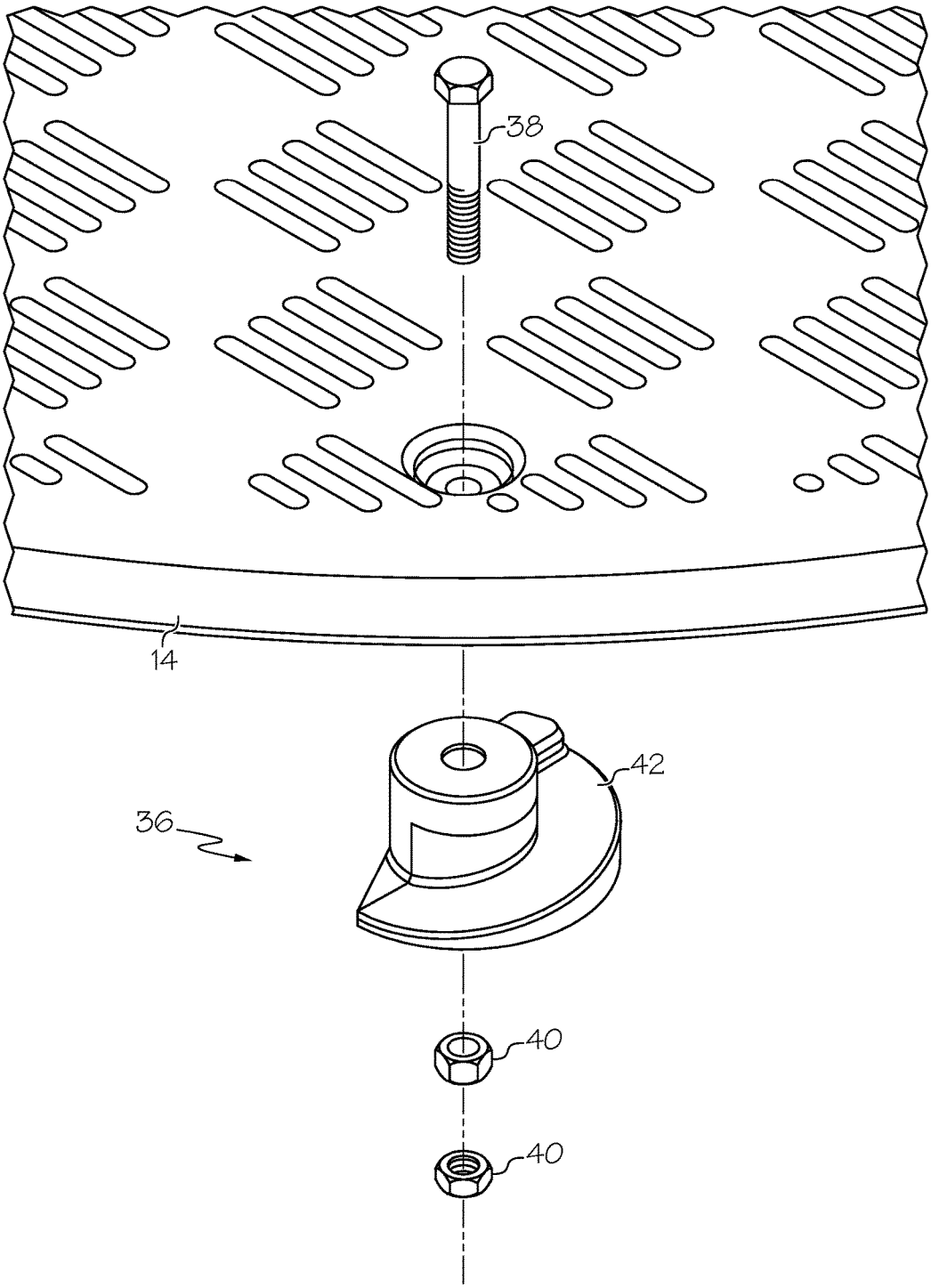
FIG. 5 is a detail perspective view of a cam lock connector used in the cover of FIGS. 1-4.

As best shown in FIG. 5, the cover 14 can include or be connected to a plurality of cam locks or cam lock connectors 36 circumferentially spaced about, and positioned adjacent to, a perimeter of the cover 14. Each of the cam locks 36 includes or is secured to the cover 14 by a bolt 38 and a pair of nuts 40 threadably connected to the bolt 38. When mounted in place each cam lock 36 is rotatable about its central axis by turning the head of the associated bolt 38, or by other means when a bolt 38 is not used. Each cam lock 36 has a circumferentially-extending outer ramp 42 that presents an increasing or decreasing thickness when the cam lock 36 is rotated. The cam locks 36 are rotatable to lock the cover 14 in place on/in the backfill protector 12/skirt 18, as will be described in greater detail below.

In order to utilize the backfill protector 12, the backfill protector 12 is first positioned in an opening in a ground surface, and positioned on top of and aligned with a sump 44, e.g. positioned as shown in FIG. 4. The sump 44 can be a liquid-tight enclosure and include its own removable cover 46 and house a variety of equipment 49 therein, such as fluid handling equipment including pumps, fluid containment chambers, overfill valves, etc. In one case, during installation of the backfill protector 12 a lower layer of backfill 48 is present, but the upper layer of backfill 50 shown in FIG. 4 is not present. In the one embodiment the lower layer of backfill 48 is soil while the upper layer of backfill 50 is concrete, asphalt or the like. However it should be understood that either the lower 48 and/or upper 50 layers of backfill can be any of a wide variety of materials, such as soil, concrete, asphalt, gravel, sand, etc.

Once the backfill protector 12 is in place as shown in FIG. 4, the upper layer of backfill 50 is filled until the upper layer of backfill 50 is, in one case, flush with the upper edge of the backfill protector 12/skirt 18, or at least positioned above the channel 32 or flush with an upper edge of the channel 32. During backfilling operations, the upper layer of backfill material 50 can naturally fill or substantially fill the recess/channel 32 and/or care may be taken during backfilling to ensure the backfill material 50 enters and fills or substantially fills the recess/channel 32, such as by packing material 50 into the channel 32. Once the upper layer of backfill 50 is in place as shown in FIG. 4 backfill 50 is positioned above the flange 34 such that the flange 34 helps to anchor the backfill protector 12 in place and resist upheaval forces. In addition the protrusions 30 help to further anchor the backfill protector 12 and limit any rotation of the backfill protector 12 about its central axis.

Once the backfill protector 12 is installed the cover 16 can be installed. In order for the cover 16 to fit into the opening 44, each of the cam locks 36 can be positioned such that their ramps 42 (or at least the thickest portions thereof) face radially inwardly, such as the left-most cam lock 36 in FIG. 4. Once the cover 16 is in place each bolt 38/cam lock 36 can be rotated to thereby rotate each cam lock 36 to present increasing ramp 42 thickness to the underside of the lower lip 26/channel 32, as shown by the right-most cam lock in FIG. 4. As the cam locks 36 are rotated the channel 32 is trapped between the underside of the main body of the cover 16 and the ramp 42 of the cam lock 36. Rotation/tightening of the cam locks 36 thus places the channel 32 in axial compression. The fill material 50 in the channel 32 provides a strengthening material that helps the channel 32 to resist compression.

Thus, the particular location and configuration of the channel 32, which is outwardly-facing to enable backfill material 50 to enter and fill the channel 32, enables the backfill material 50 to act as a structural component of the backfill protector 12 once the backfill protector 12 is fully installed. Besides providing stiffness to enable the channel 32 to resist compression by the cam locks 36, the backfill material 50 in the channel 32 also strengthens/supports the upper lip 22 to aid the upper lip 22/channel 32 in supporting the weight of the cover 16 and forces applied to the cover 16 (e.g. when vehicles are driven over the cover 16). In this manner the backfill protector 12 can be made of a relatively thin-walled and/or weaker material compared to other backfill protectors since the backfill protector 12 need not be able to, alone, resist the compressive forces applied by cam locks 36 or other forces. This, in turn, enables the backfill protector 12 to be made of thinner and/or lighter materials, provides for a more inexpensive backfill protector 12 that is easier to handle and install.

It has been found that fill material 50 in the form of concrete positioned in the channel 32 can reduce deflection of the channel 32, when exposed to a 850 pound load by a cam lock 36, by at least about ten times, up to about seventy-eight times, depending upon the material and thickness of the channel 32. The channel 32 can have an axial height that is at least about equal to the thickness of the material defining the channel 32, or at least about double the thickness of the material defining the channel 32, or less than about ten times the thickness of the material defining the channel 32, or less than about five times the thickness of the material defining the channel 32, so that the channel 32 can be made sufficiently thin but can receive sufficient material 50 therein for strengthening. The channel 32 can have an axial height that is greater than about 3% and/or less than about 12% of a height of the backfill protector 12.

The channel 32 may extend radially inwardly sufficiently to enable the channel 32 to be engaged by the cam locks 36, but may not extend radially inwardly sufficiently to unduly block the upper opening 14. In one case the channel 32 has a radial length that is about 3% of a radius or average radius of the opening 14, and/or less than about 10% or greater than about 0.5% of a radius or average radius of the opening 14. In one embodiment the backfill protector 12/skirt 18, or at least the channel 32, is made of a relatively thin-walled materials such as composites or polymers (including but not limited to polyethylene) or metal (including but not limited to steel) having a wall thickness of less than about 0.50 inches, or less than about 0.20 inches in another case. In one case, for example when the channel 32 and/or backfill protector 12 is made of polymer materials such as polyethylene, the channel 32 and/or backfill protector 12 has a thickness of less than about 0.5 inches, or less than about 0.3 inches, or greater than about 0.05 inches, or greater than about 0.1 inches. In one case, for example when the channel 32 and/or backfill protector 12 is made of metal such as steel, the channel 32 and/or backfill protector 12 has a thickness of less than about 0.3 inches, or less than about 0.2 inches, or greater than about 0.03 inches, or greater than about 0.05 inches.

Having described the invention in detail and by reference to certain embodiments, it will be apparent that modifications and variations thereof are possible without departing from the scope of the invention.

What is claimed is:

1. A system comprising:

a backfill protector including a skirt having an opening configured to receive a cover therein and a lip extending around a perimeter of the opening, the lip being configured to support the cover thereon, the skirt further including an inwardly-extending channel positioned adjacent to the lip; and a cover including at least one cam lock connector configured, when the cover is positioned in the opening, to engage an underside of the channel and apply a compressive force to the channel to thereby secure the cover in place.

2. The system of claim 1 wherein the channel is positioned immediately below the lip when the backfill protector is in an installed position.

3. The system of claim 1 wherein the channel is open at its radially outer end to allow backfill positioned adjacent to the skirt to enter the channel.

4. The system of claim 1 wherein the skirt includes a radially outwardly-extending flange positioned adjacent to the channel, wherein the flange is aligned with the lip and extends radially outwardly beyond the channel.

5. The system of claim 1 wherein the channel is defined by the lip, a sidewall oriented generally perpendicular to the lip, and a supplemental lip oriented generally parallel to the lip.

6. The system of claim 5 wherein the lip and the supplemental lip are each oriented in a radial plane and has a length in the radial plane, and wherein the lip has a length greater than a length of the supplemental lip.

7. The system of claim 5 wherein the skirt includes a lower body positioned below the supplemental lip when the backfill protector is in an installed position.

8. The system of claim 1 wherein the channel extends around the perimeter of the opening.

9. The system of claim 1 wherein the lip and the channel each extend around the entire perimeter of the opening.

10. The system of claim 1 wherein the skirt is annular in shape, and wherein the opening and the cover are each generally circular in top view.

11. The system of claim 1 wherein the cam lock connector has a ramp of variable thickness extending circumferentially about a periphery thereof.

12. The system of claim 1 wherein the backfill protector is installed with backfill surrounding the backfill protector, and wherein backfill is positioned in the channel to aid the channel in resisting a compressive force applied thereto.

13. The system of claim 12 wherein the backfill protector is positioned above and aligned with an underlying sump.

14. The system of claim 1 wherein the skirt is made of a polymer material or a metal with a thickness of less than about 0.50 inches.

15. The system of claim 1 wherein the channel has a height less than about 10 times a thickness of a material defining the channel.

16. A system comprising:

a backfill protector including a skirt defining an inner cavity, the backfill protector having an opening configured to receive a cover therein and further having a channel extending around a perimeter of the opening, the channel being configured to support the cover thereon, wherein the channel is open at its radially outer end to enable the channel to receive material therein, wherein the channel has a height less than about 12% of a height of said backfill protector, and wherein the channel extends into said inner cavity such that a connector can engage said channel and apply a compressive force thereto; and a cover including at least one cam lock connector configured, when the cover is positioned in the opening, to engage an underside of the channel and apply a compressive force to the channel to thereby secure the cover in place.

17. The system of claim 16 wherein the channel is defined by an upper lip generally aligned in a radial plane, a lower lip generally aligned in a radial plane that is axially spaced away from said upper lip, and a sidewall extending therebetween.

18. The system of claim 16 further comprising a cover including at least one cam lock connector configured, when the cover is positioned in the opening, to engage an underside of the channel and apply a compressive force to the channel to thereby secure the cover in place.

19. The system of claim 16 further comprising a cover including at least one connector that is configured, when the cover is positioned in the opening, to engage the channel and apply a compressive force to the channel to thereby secure the cover in place.

20. The system of claim 16 wherein said channel includes a lip and a supplemental lip extending into the inner cavity.

21. The system of claim 20 wherein the lip and supplemental lip are each arranged in a radial plane, are generally parallel and spaced axially apart, and extend radially inwardly from said skirt.

22. A method for installing a system comprising:

accessing a sump;

positioning a backfill protector above the sump, the backfill protector including a skirt having an opening configured to receive a cover therein and a channel extending around a perimeter of the opening, the channel being configured to support the cover thereon and being open at its radially outer end, and wherein the channel has a height less than about 10 times a thickness of a material defining the channel;

positioning backfill material about the backfill protector such that the backfill material at least partially enters the channel; and positioning a cover in said opening, said cover including at least one cam lock connector configured, when the cover is positioned in the opening, to engage an underside of the channel and apply a compressive force to the channel to thereby secure the cover in place; and said cam lock connector applying a compressive force to the channel to thereby secure the cover in place.

23. The system of claim 1 wherein the channel has a height less than about 12% of a height of said backfill protector.

* * * * *